United States Patent [19]

Dammann et al.

[11] 4,130,983

[45] Dec. 26, 1978

[54] YARN SPINNING APPARATUS AND PROCESS

[75] Inventors: Peter Dammann; Heinz Schippers; Herbert Turk, all of Remscheid; Herbert Schiminski, Huckeswagen, all of Germany

[73] Assignee: Barmag Barmer Maschinenfabrik Aktiengesellschaft, Remscheid-Lennep, Germany

[21] Appl. No.: 782,310

[22] Filed: Mar. 28, 1977

[30] Foreign Application Priority Data

Mar. 27, 1976 [DE] Fed. Rep. of Germany ..... 2613263

[51] Int. Cl.[2] ..... D01H 1/12; D02G 3/36; D02G 3/38

[52] U.S. Cl. ..... 57/5; 57/58.89; 57/58.95

[58] Field of Search ..... 57/5, 58.89–58.95, 57/77.4, 77.42, 160

[56] References Cited

U.S. PATENT DOCUMENTS

| | | | |
|---|---|---|---|
| 1,343,076 | 6/1920 | Booth | 57/5 |
| 2,202,118 | 5/1940 | Newman et al. | 57/5 |
| 2,208,897 | 7/1940 | Dockerty et al. | 57/5 |
| 2,943,433 | 7/1960 | Van Dijk | 57/77.42 x |
| 3,842,582 | 10/1974 | Richter | 57/77.4 |
| 3,913,310 | 10/1975 | Fehrer | 57/58.89 X |
| 3,972,173 | 8/1976 | Fehrer | 57/58.89 |
| 3,981,137 | 9/1976 | Fehrer | 57/58.89 X |
| 4,002,016 | 1/1977 | Fischer et al. | 57/58.95 |

*Primary Examiner*—Charles Gorenstein
*Attorney, Agent, or Firm*—Keil, Thompson & Shurtleff

[57] ABSTRACT

Yarn spinning machinery and process utilizing a pair of perforated sieve belts, cylindrical sieve drums or hyperboloid sieve drums for twisting staple fibres at a line of yarn formation wherein the sieve members are moving in opposite directions while air currents are drawn through the sieve members on opposite sides of, and in opposite, twist-assisting flow directions, the line of yarn formation.

54 Claims, 9 Drawing Figures

YARN SPINNING APPARATUS AND PROCESS

In one method of spinning (Malliand Textilberichte 1975, Volume 9, page 690 et seq), a card sliver composed of staple fibres is separated into its individual fibres by means of a rapidly rotating carding roller and then transferred to a rotating cylindrical sieve drum. On the inside of this drum is a suction pipe which opens along a generatrix of the internal surface of the drum. The air suction produced by this pipe draws the staple fibres against the external surface of the sieve drum and should in addition hold the fibres on the external generatrix of the drum in the area of the pipe. The rotation of the sieve drum introduces a moment of torsion into the fiber mass, whereby the individual fibres are grouped together to form a bundle along the line of filament formation and formed into a yarn by a real twist. The disadvantage of this arrangement is that the individual fibres have only an unstable position on the aforesaid generatrix. They will depart from this generatrix and the spinning process will break down if the speed of rotation of the sieve drum, the current of air produced by suction and the titre of the spun yarn are not correctly attuned to each other or are subject to fluctuations. Moreover, the air current produced by suction counteracts the rotation of the fibre bundle forming on the generatrix because on one side of this bundle the air current is directed opposite to the rotation. The same principle has also been described in German Offenlegungsschrift No. 23 61 313 in which suction is again provided to produce an air current which has a powerful component of flow against the direction of the moving surface but which opposes the forces of torsion which effect twisting of the sliver.

A process for spinning textile fibres has been disclosed in German Offenlegungsschrift No. 24 49 583, in which the fibres are twisted into a sliver in the nip between two sieve drums rotating in the same sense about parallel axes. Inside each of these drums is an air suction device, the open end of which is directed towards the nip in which the yarn is formed. The air currents press the fibres against the drum walls in the region of the nip.

This method has the disadvantage that one of the sieve drums as well as the current of suction associated with this drum oppose the desired direction of twisting of the sliver. Here again, stable conditions are difficult to achieve and occur only if the sliver or yarn is kept on the line of filament formation by draw-off rollers arranged transversely to the nip.

It is an object of the present invention to provide a process which obviates the disadvantages described above. In particular, it is intended that the sliver should not be subjected to opposing forces of torsion by the moving surfaces or air currents. In addition, a more stable operating point should be obtained without the aid of special thread guide elements and independently of the given operating parameters.

The solution to this problem is provided by the subject process and apparatus improvements, in which the fibres are twisted together between two adjacent air permeable surfaces moving in opposite directions, which surfaces are permeated by two air currents, and characterized in that the vectors of movement of the moving surfaces, e.g., belts or drums, and of the air currents compositely encircle the line of yarn formation in the same direction of rotation as the yarn which is to be formed. Preferably, the vectors of movement of the surfaces lie in parallel planes at the line of yarn formation, and the distance between the surfaces at the line of yarn formation is adjustable and, at the point of exit of the formed yarn from said moving surfaces, is not substantially less than the diameter of the yarn which is spun and discharged. When the surfaces are cylindrical surfaces, the line of yarn formation lies in the plane drawn through the axes of the two cylinders. Still further, the vectors of movement by said moving surfaces may have a vector component in the direction of axial movement of the yarn between the surfaces.

In a special adaption, the process for the production of a yarn from individual fibres of differing origins is characterized in that a portion of the fibres is supplied to each of the moving surfaces, whereby fibres of one origin or type are supplied to one of the surfaces and fibres of different origin or type are fed to the other surface. Also, supply of the fibres of one origin or type may be axially displaced along the line of yarn formation from the supply of fibres of a different origin or type. The process thus provides both spinning and combining fibres of two or more different origins or types--thereby providing effect yarns with different properties of the core fibers and the outer or sheath fibres in cases where the core fibres are fed to the line of yarn formation spatially in advance of the outer or sheath fibres.

A continuous filament may be delivered on the line of yarn formation to form the core of the yarn, and the distance of the air permeable surfaces in the line of yarn formation is sufficient to prevent their contact with the continuous filament.

Apparatus for carrying out the process comprises two air permeable surfaces moving in opposite directions, between which surfaces the staple fibres are rotated and twisted. Air suction means are provided on sides of the moving sieve surfaces which are opposite to the fibre-contacting surfaces. The air suction means associated with a given surface is situated ahead of the line of yarn formation, viewed in the direction of movement of the respective surfaces. Preferably, the sieve belt surfaces lie in parallel planes in the region of the line of yarn formation. Advantageously, the torsion moments to be exerted on the fibres and/or the formed yarn should be relatively small. The subject spinning machines should not be used in cases of heavy or thick fibres or in the production of yarns of very high twist. In most cases, the subject machinery should not be used to generate the total amount of torsion required for the final degree of twist of most yarns.

The feed devices are provided for the supply of the individual fibres, each of which feed devices is directed in the vicinity of one of the surfaces and arranged ahead of the line of yarn formation, viewed in the direction of movement of its surface. In a specific embodiment, the moving surfaces are surfaces generated by hyperboloids, the axes of which are at an angle to each other so that the line of yarn formation is parallel to one generatrix of each hyperboloid, and the feed device opens onto a generatrix of the hyperboloid.

Discs, the diameter of which is greater than the diameter of the cross-section of the hyperboloids, are mounted on the hyperboloids at the yarn discharge end. A twisting device may follow the apparatus, which twisting device preferably also has a component of movement in the direction of yarn delivery.

In contrast to German Offen. No. 24 49 583, in which it is necessary to form a nip between the moving surfaces, this is unnecessary although possible with the process and apparatus according to the invention. This means that when sieve drums are used, the yarn is formed, i.e., the line of filament formation is situated, where the surfaces of the sieve drums are the least distance apart. At all events, the suction devices according to this invention are arranged on both sides of the line of filament formation and do not intersect or only very slightly overlap in the zone between the moving surfaces where the line of filament formation should be situated. The surfaces moving in opposite directions may be formed by sieve belts moving in opposite directions or by sieve drums rotating in the same direction.

The forces acting on the fibres preferably also have components in the direction of feed of the yarn. This can be achieved particularly advantageously by means of sieve drums having the form of hyperboloids since such drums not only orientate the individual fibres in the direction of the sliver which is to be formed but also transport the fibres and yarn, in particular if gripping zone is formed in the proximity of discs at the downstream ends of the hyperboloids. The distance between the sieve drums or moving surfaces is selected to be preferably not smaller than the diameter of the yarns which are to be formed. The maximum distance is limited by the speeds of rotation attainable since a large distance between the drum surfaces and axis of the yarn and high yarn draw-off rates necessitate very high circumferential velocities of the sieve drums.

The process and apparatus herein can also be used very advantageously for producing a yarn from fibres of different origins, for example natural fibres and synthetic fibres obtained from different raw materials or synthetic fibres differing in their properties may be mixed. Hitherto it was always necessary to carry out such mixing before the spinning apparatus. This novel method of mixing and spinning is achieved by supplying fibres at different origins to respective air permeable surfaces. This combined mixing and spinning process may be used to produce fancy yarns with core fibres differing from the external fibres if the core fibres are carried to the line of yarn formation ahead of the external fibres.

The moments of torsion exerted on the fibres or sliver by the apparatus should preferably be relatively small and the apparatus should not be used for producing the entire moment of torsion required for twisting the yarn. The apparatus is therefore advantageously used in combination with twisting devices of the types which may be known per se.

The invention will now be described with reference to the drawings, which illustrate preferred embodiments.

Figure 2:
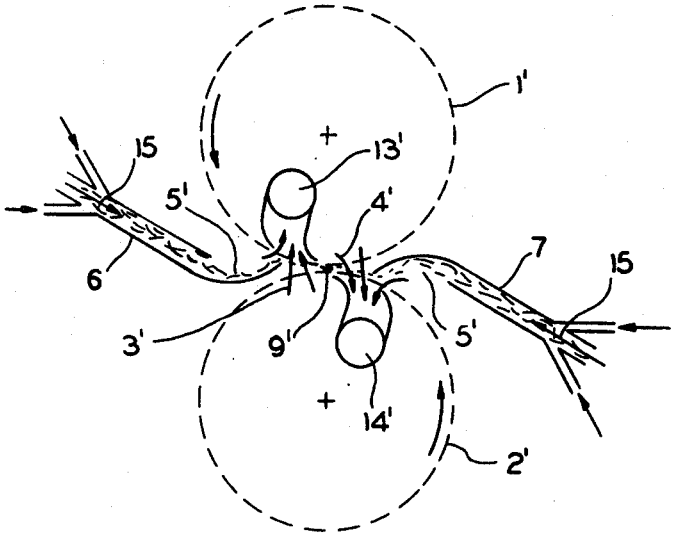
FIG. 2 is a schematic side elevation of one embodiment in which the fibres are fed in from both sides.
Figure 2A:
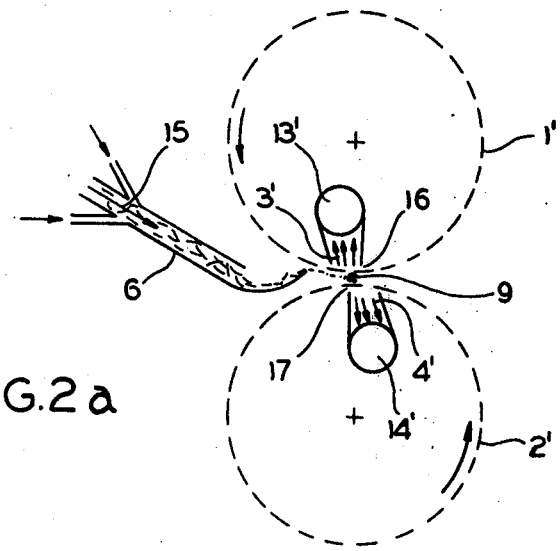
Figure 3:
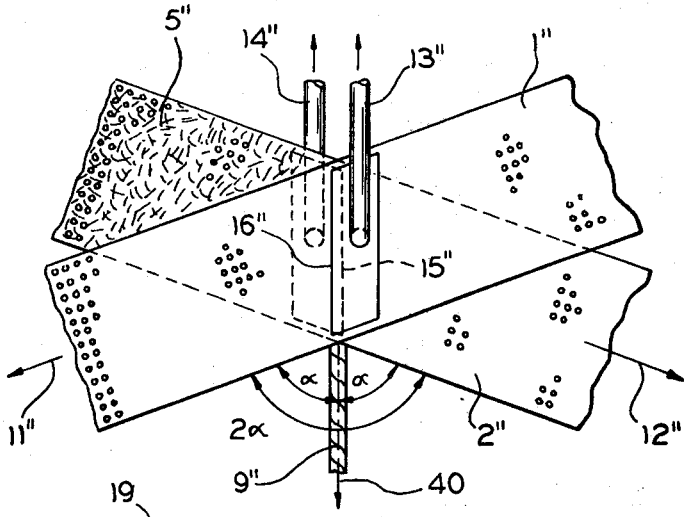
Figure 4:
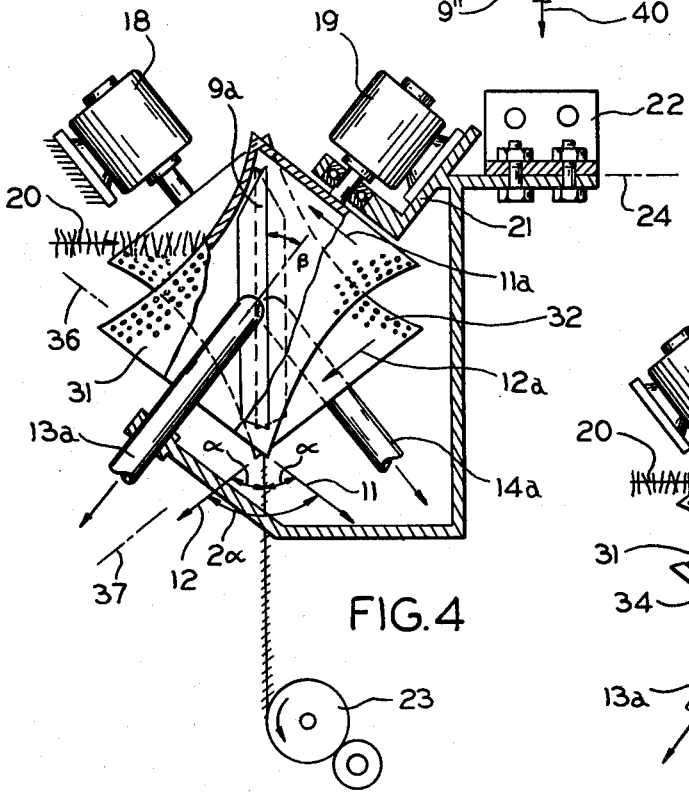
Figure 4A:
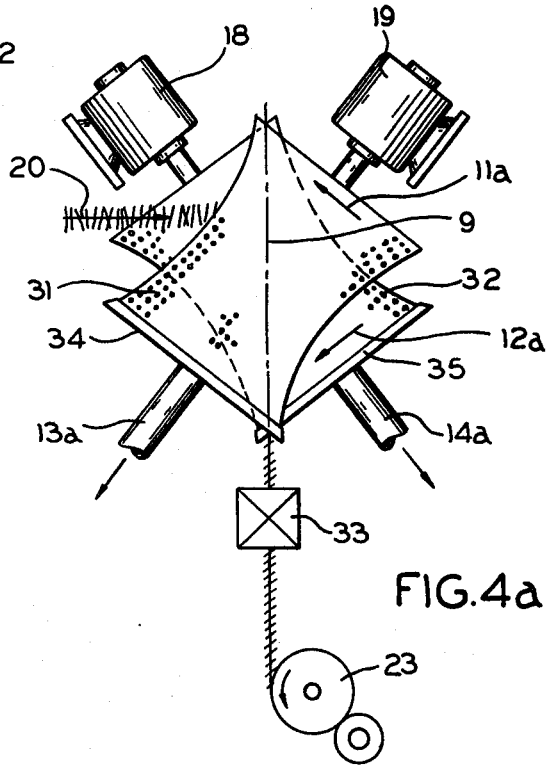
Figure 5:
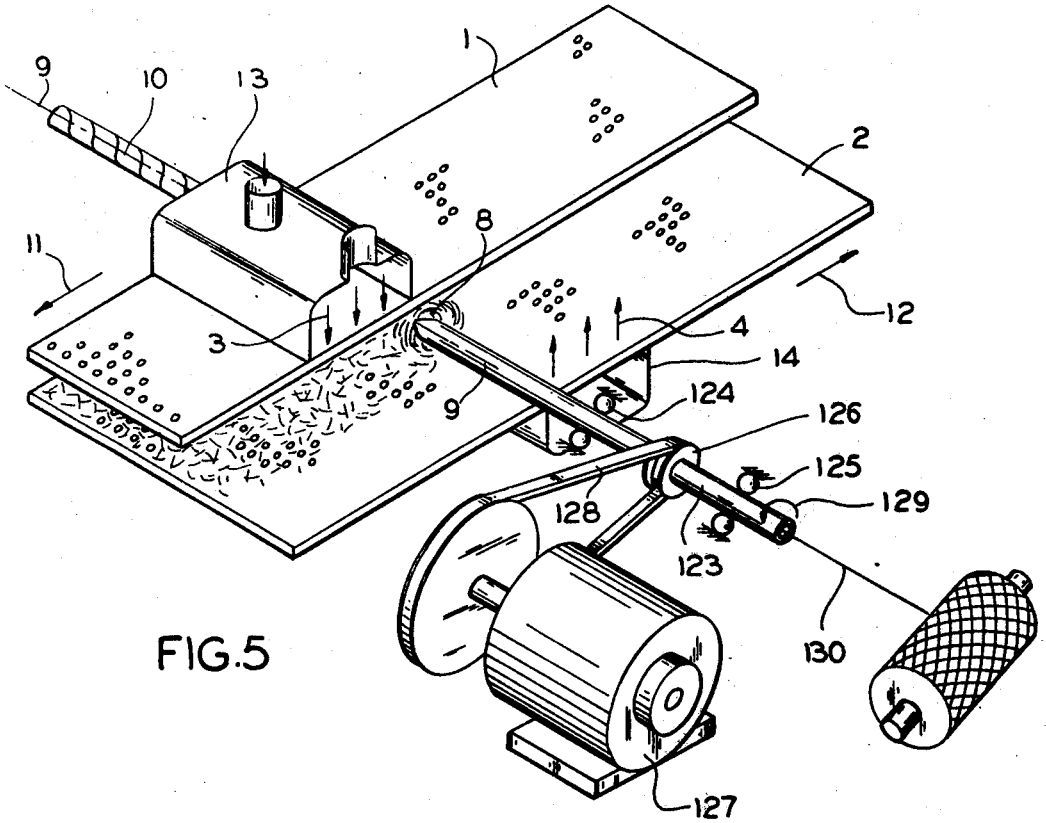
Figure 6A:
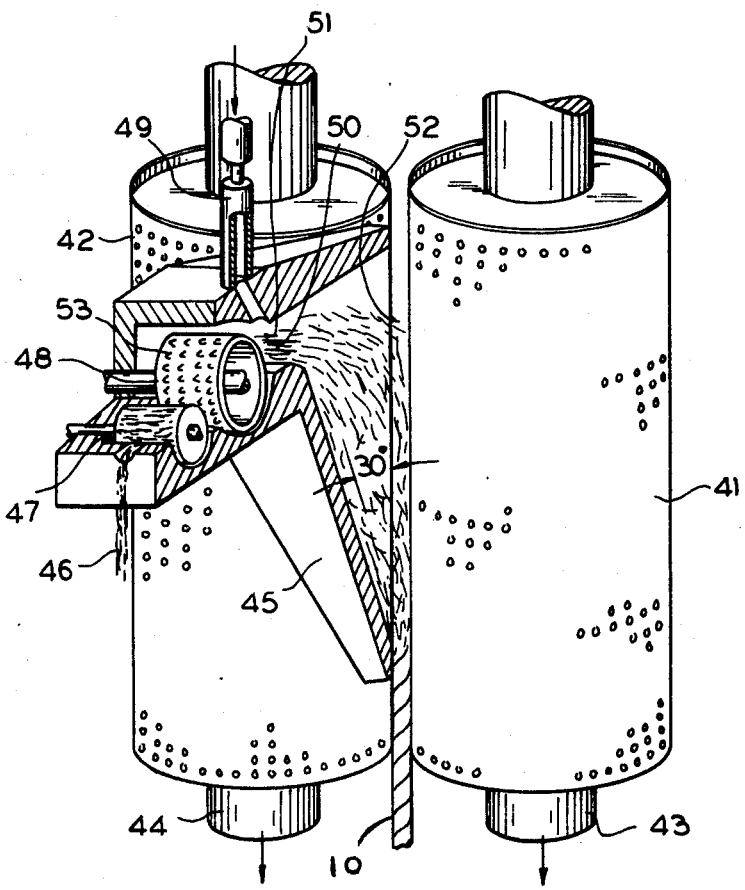
Figure 6B:
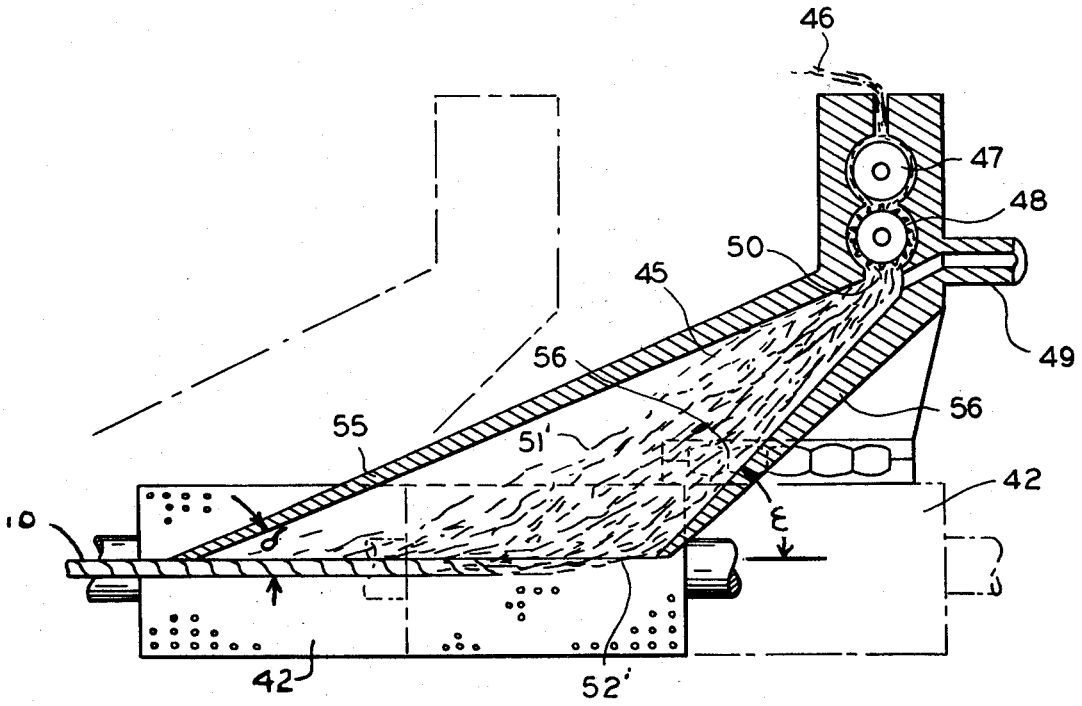

FIG. 2*a* is a diagrammatic view of the air current movements and their physical effect on the bundle of feed fibers in forming the sliver;

FIG. 3 is a plan view of another embodiment;

FIG. 4 is a plan view of another embodiment utilizing drums with hyperboloid permeable surfaces;

FIG. 4*a* is a plan view of the same type of apparatus in combination with a yarn twister;

FIG. 5 is a perspective view of another embodiment with portions broken away to facilitate illustration;

FIG. 6*a* is a fragmentary, perspective view of a perforated cylinder pair in association with a fibre carding device; and FIG. 6*b* is a section view of another embodiment similar to FIG. 6*a* on a section plane between the perforated cylinders and through the carding device.

Figure 1:
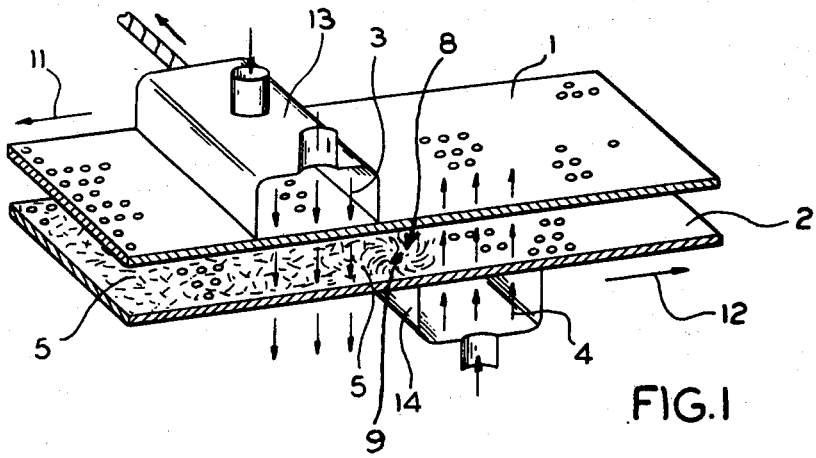
FIG. 1 is a perspective diagram of the principles of the spinning process.

Sieve belts 1 and 2 moving in opposite directions 11 and 12 are represented schematically in FIG. 1. Air currents 3 and 4 passing through the sieve belts are produced by air supply means 13 and 14. The individual fibres 5 are delivered to one or both sieve belts. These fibres are first pressed against the sieve belt 2 by the air current 3. When the individual fibres enter the zone of the air current 4, they are pressed against the sieve belt 1 by this current. Since the belt 1 moves in the opposite direction to belt 2, the individual fibres are carried back in the direction of the first air current. This circular motion causes the fibres to be rolled up into a yarn sliver 8. The vectors of motion of the sieve belts 1 and 2 and of the air currents 3 and 4 encircle the line of yarn formation 9 in the same direction, thereby ensuring that the sliver 8 has a stable position on the line of yarn formation 9. The resulting yarn 10 is continuously pulled out of the zone between the surfaces of the belts by winding devices (not shown).

The embodiment shown in FIG. 2 comprises cylindrical sieve drums 1' and 2' which rotate in the same sense so that their surfaces move in opposite directions in the region of the line of yarn formation 9. On both sides of this line, suction devices 13' and 14' are arranged in the interior of the drums 1' and 2'. Each of these suction devices produces an air current 3' or 4' penetrating the respective sieve drum.

The individual fibres are fed to the apparatus by the fibre feed device 6 or the fibre feed device 7 or both. The fibre feed devices 6 and 7 are in the form of channels each ending in a curved plate which in turn ends at the sieve drum 1' or 2'. Transport of the individual fibres in the fibre feed devices can be effected by the pneumatic injector 15. Each of the fibre feed devices 6 and 7 may have a carding roller of known construction arranged ahead of it.

The individual fibres which have been transferred to the sieve drums 1' and 2' in the region of the air currents 3' and 4' by the fibre feed devices 6 and 7 are pressed against the drum surfaces by the air currents and carried into the zone of the line of yarn formation 9. The open ends of the suction devices overlap only slightly in the region of this line 9. The directions of the vectors of movement of the sieve drum surfaces indicated in FIGS. 2 and 2*a*, and the directions of the air currents combine to convert the individual fibres into a sliver along the line of yarn formation 9. The yarn/yarn sliver formed along the line 9 is removed from the spinning zone, for example by means of the winding device, and may subsequently be subjected to further torsion by means of a suitable twisting device to twist it into a yarn. This twisting device may, for example, comprise three shafts rotating in the same direction arranged at the corners of an isosceles triangle, on which friction discs are mounted in succession, these discs overlapping at the centre of the isosceles triangle. The sliver is passed through the centre of this triangle. These friction discs both twist the sliver and transport the sliver or yarn.

The similar arrangement shown in FIG. 2*a* feeds the fibres from only one side, i.e., via the feed device 6. Here the suction devices 13' and 14' have air-entry openings 16 and 17 closer together than in FIG. 2, e.g., an edge of each respective opening being immediately above and below the line of yarn formation 9 with a slight overlap relative to the plane drawn through the axes of rotation of the drums 1' and 2'.

The narrowest gap between the sieve drums 1' and 2' is approximately equal to the diameter of the yarn to be formed, preferably somewhat smaller at the end where the yarn is discharged. In the area of the fibre feed, the nip is two to three times greater than the diameter of the yarn to be formed. For production of a cotton yarn (Nm. 10) a preferable dimension of the nip was 0.1 mm at the yarn discharge end and was 0.5 mm of the fibre feed area. For a cotton yarn (Nm. 20) the respective nip dimensions were 0.2 and 0.8, respectively.

The position of the air entry opening 16 determines the location of the line of yarn formation and ranges up to ten times the produced yarn diameter, viewed in the direction of movement of the cylinder 1', ahead of the plane through the two cylinders axes of rotation. The uniqueness of the embodiment of FIG. 2*a*, furthermore, resides in that the air opening 17 of the suction unit 14' in the cylinder 2' overlaps the air entry opening 16 of the suction unit 13' in area of overlap of predetermined amount. The distance of the air entry opening 16 and the air entry opening 17 in terms of overlap of their respective longitudinal edge portions is up to ten times the yarn diameter. With this arrangement of the entry openings, the line of yarn formation 9 is certain to lie ahead of the nip between cylinders 13' and 14'. This favors the stabilization of the line of yarn formation and also the increase of the torsion moment to be generated.

In FIG. 3, the principle of twist-impartation with simultaneous longitudinal feeding by the twisting members of the produced yarn is illustrated. The sieve belts 1'' and 2'' move in parallel planes in the directions 11'' and 12''. Suction devices 13'' and 14'' are arranged on the two sides of the line of yarn formation 9, optionally with slight overlapping of their openings. The individual fibres 5'' are fed onto the belt 2'' and may in addition be fed onto the belt 1'', and they are pressed against the belt by the suction devices. The fibres are then twisted according to the principle already described above.

Simultaneously sieve belts 1'' and 2'' also have a motion component in the feeding direction. As seen from above, the sieve belts form an intersection angle $2\alpha$. The mouth edges 15'', 16'' of the suction means 13'', 14'' which define the line of yarn formation 9'', are disposed on the bisecting line of this angle $2\alpha$, or at a slight displacement parallel thereto, so that the mouths overlap. The displacement relatively to the angle bisecting line may also be as much as 10*d* wherein "d" is the yarn diameter. It may be mentioned that the air currents generated by suction means 13 and 14 also may have a motion component in the feeding direction. The operating principle described above, in which twisting by means of rotating force vectors and feeding take place simultaneously is realized in practice by sieve drums according to FIG. 4 which are formed as hyperboloids. These hyperboloids are arranged so that their axes lie in mutually parallel planes, or that each of them has a genetrix which extends parallel to the line of yarn formation 9.

This means that in projecting the two axes onto one plane, the angle between them is twice as great as the angle $\beta$ at which each genetrix intersects its corresponding hyperboloid axis. The motion vectors 11, 12 of the surface velocities of the hyperboloid circumferential surfaces in the narrowest gap between the parallel genetrices, intersect at the above defined angle $2\alpha$. It should be mentioned here that the air currents produced by the suction devices 13'' and 14'' may also have a component of movement in the direction of linear yarn movement.

The spacing between the sieve belts 1' and 2' is correlated to the ultimate diameter of the produced yarn. The maximum width of the overlap of the inlet openings of the suction devices 13' and 14' is ten times the diameter of the yarn being formed. The yarn diameter is selected, as above, relative to the degree of twist of yarn. Such diameter is calculated by the formula:

$$d\,(\mathrm{mm}) = \frac{1{,}12838}{\sqrt{\delta(\mathrm{g/cm^3}) \times \mathrm{Nm}}}$$

In this equation, $\gamma$ is the specific weight, and Nm (the metric number) is the finest of the yarn measured in meters per gram.

The operating principle described earlier in this text, in which the fibres are twisted by circular vectors of force and at the same time transported, is in practice realized by the sieve drums according to FIG. 4, and FIG. 4*a*, which drums have the form of hyperboloids. These hyperboloids are so arranged that their axes lie in parallel planes. Moreover, each hyperboloid has a rectilinear generatrix parallel to the line of yarn formation 9. This means that the angle formed by the projection of the two axes on one of the two planes is twice the angle of intersection between the generatrix and the given axis of the hyperboloid.

The hyperboloids were arranged so that the narrowest gap formed by the adjacent genetrices is substantially rectangular. Since hyperboloid body 31 with its bearing bracket 21 is slidably mounted by bolts on support 22 and since the support 21 and bracket 22 are rotatable about the axis 24, it is possible to adjust the gap width and/or incline of the hyperboloid body 31 so that the narrowest gap between the hyperboloid bodies becomes narrower in the direction of the yarn exit. In this manner, the friction forces which the hyperboloid bodies exert on the fibreyarn composite (the fibres in the process of being formed into a yarn along the line of yarn formation) are increased with the compression of the composite. In this manner one may avoid exposure of the composite to excessive torsion moments and/or tension forces which could result in the rupturing of the composite. Further, the narrowing of the gap along the line of yarn formation in the direction of longitudinal movement of yarn in the gap insures that torsion moments can be exerted on the exiting yarn in such magnitude that sufficient twist results. The dimensions of the narrowest gap are adjusted so that, in the zone of the feed of the fibres 20 the gap is two times greater than the yarn diameter while in the zone of the yarn exit from the gap the latter is smaller than the diameter of the yarn produced.

The hyperboloid sieve drums 31 and 32 are driven in the directions 11*a* and 12*a* by motors 18 and 19. Inside these drums are suction devices 13*a*, 14*a*, and the opening of each suction device extends over part of the internal circumference of the associated drum 31 or 32 and ends shortly before, on or shortly behind the line of yarn formation 9, preferably with the aforesaid type of overlap on the fibre feeding side (cf., fibres 20) before the narrowest gap between drums. The fibre feed device or devices are not shown in FIG. 4. It consists of a channel with a slot-like mouth, which channel extends into the narrowest gap between the hyperboloid bodies 31, 32 whereby the mouth extends over at least part of the gap length. The produced yarn is withdrawn by winding means 23, possibly with the interposition of a delivery system at a velocity Va. The fibres 20 may be supplied to the drum 31, for example, in the direction of the arrow.

Circular rims 34 and 35 are provided on the end discs at the outlet end of the hyperboloid sieve drums. These rims have a clamping action on the fibres which have at this stage already been joined together to form a sliver. In the region of the line of yarn formation, the hyperboloid sieve drums have one component of movement which produces the twist and another component which transports the individual fibres and the sliver which is being formed on them. This transporting movement is assisted by the bevelled rims 34 and 35. (FIG. 4*a* only)

In operation, the surface velocity of the hyperboloids is matched carefully to the desired twist as well as the desired yarn withdrawal velocity, whereby a compromise is to be made with the tolerable tensile strength of the yarn produced. The withdrawal velocity is limited particularly by the fact that the yarn must not be exposed to excessive yarn tension forces while, on the other hand, it must not become slack. The desired magnitude of $\alpha_m$ depends on the intended use of the yarn.

Experiments with a spinning device according to the invention with slightly overlapping suction means yield the results:

| | |
|---|---|
| Hyperboloids: | |
| Max dia. | 85 mm |
| Gap width | 0.3 mm |
| Suction overlap | 0.9 mm |
| Intersecting angle of motion vectors (2α) | 140° |

Yarn:

Cotton

Nominal staple, 28 mm = 1.54 g/cm$^3$

Nm-24 m/g Withdrawal velocity — 300 m/min.

$\alpha_{metric} = \alpha_m =$ metric rotation coefficient = 120

($\alpha_m$ is substantially the application specific coefficient by which the twist of the yarn is calculated by the formula) — by experience, ranges from 100 to 150

$T = \alpha\sqrt{Nm}$

The magnitude of $\alpha_m$ depends on the end use of the yarn.

The rotation velocity of the hyperboloids is such that both have the same circumferential velocity at the point of the yarn exit. Measured was the withdrawal tension of the yarn by which the yarn is to be withdrawn from the spinning device as well as the twist (T/m) actually obtained and as well as the strength of the yarn (Rkm). The calculated optimal ranges were determined by the following formulae:

$$4{,}25 \times 10^{-3} \frac{\alpha m \times V_a}{\sqrt{\delta} \times \sin\alpha} < \mu < 0{,}95 \frac{V_a}{\cos\alpha}$$

as the larger range and $$4{,}25 \times 10^{-3} \frac{\alpha m \times V_a \times \sin\alpha}{\sqrt{\delta}} + V_a \times \cos\alpha < \mu < 0{,}85 \frac{V_a}{\cos\alpha}$$

as the narrow range.

It followed that favorable values for surface velocity u were to be obtained in the following ranges:

132 m/min < 220 m/min < u < 746 m/min < 833 m/min.

The following table shows the experimental results:

| U m/min | 100 | 200 | 400 | 600 | 800 | 900 |
|---|---|---|---|---|---|---|
| p (p) | 55 | 32 | 28 | 22 | 19 | 15,7 |
| t (l/m). | 375 | 505 | 630 | 680 | 730 | 795 |
| Strength (Rkm) | 5,7 | 9,2 | 11,8 | 11.2 | 10,2 | 8,4 |
| α metric | 76,5 | 103 | 128,6 | 138 | 149 | 162 |

The embodiment of FIG. 4*a* corresponds to that of FIG. 4 with the addition of the twisting device 33 of any design. The resulting yarn is wound on winder 23.

It should also be mentioned with reference to FIG. 2 that the fibres may be supplied either from the fibre feed device 6 or from the fibre feed device 7 or from both. According to the invention, by supplying fibres from both feed devices 6 and 7 it is possible to produce mixed fibre yarns if one type of fibre is supplied through 6 and another type of fibre through 7. The spinning apparatus represented in FIG. 2 can therefore be used for both mixing and spinning individual fibres. The feed devices 6 and 7 may be staggered in relation to the line of yarn formation or additional fibre feed devices may be provided behind the devices 6 and 7. In this way it is possible to spin yarns in which the core differs from the outside in the origin of the individual fibres and the structure. Fancy yarns can be produced in this way, for example with a core and sheath structure.

From the experimental results in the table above, it can be seen that too high circumferential velocities give rise on the one hand to too high a twist and on the other hand to a decrease in yarn strength. Both are disadvantageous for the processing. In the lower limit range, the twists attained are so low that a sufficient yarn strength cannot be obtained. The circumferential surfaces of the hyperboloids may be decreased, e.g., by shortening one end of each so that the ends lie in normal planes 36, 37. The hyperboloids, accordingly, are asymetric in the longitudinal direction. Such asymetric spinning units are useful where no tension forces are to be exerted on the yarns being produced.

An advantage in using the beveled rims 34, 35 (FIG. 4*a*) is that an additional increase of the torsion moment is provided thereby where, for rough fibers or for very high twists, a high torsion moment is required to produce the needed twists. In these cases an additional false twist imparter 33 following the spinning device may be used.

In the subject spinning methods, it has been found that, in the instance of thick yarns and particularly of thick yarns with high sheen, a non-uniformity of the twist over the transverse section of the yarn results. It has been observed that the fibres in the core of the produced yarn have a lower number of twists per meter than do the fibres in the sheath or outer portions of said yarn. Accordingly, it is a further object of the invention to obtain a uniform twist over the transverse cross section of the produced yarn even in the instance of thick yarns. For this purpose, an additional torsion moment is introduced into the yarn sliver as it is being formed by means of a rotating needle.

The core of the yarn may be formed from an endless filament, for example a continuous synthetic fibre filament descending on the line of yarn formation 9 and passing between the surfaces, for example as indicated in FIG. 4. This method can be used to produce a spun yarn in which the core is made up of continuous filament and the sheath of staple fibres. Advantageously the continuous filament is a textured, crimped yarn with a three-dimensional crimp as results, for example, in false twist texturizing or in blown air texturizing.

In FIG. 5, like in FIG. 1, the yarn 10 being formed is, by means of winding apparatus (not shown), continuously drawn from one side of sieve belts 1 and 2 out of contact of the opposed belt surfaces. At the other end, a solid or hollow needle 123 is rotatably supported by bearings 124, 125. The needle is driven by motor 127, drive belt 128, and pulley 126 in the direction of rotation (arrow 129) consistent with the direction of movements of belts 1 and 2 and air currents 3 and 4, i.e., in the direction of fibre rotation at the line of yarn formation 9. The needle may be moved in axial direction so that its tip enters in variable depths into the area where the fibres 5 become twisted about the line of yarn formation 9. In experiments of variable depth of penetration, a penetration of the needle end into the body of twisting fibres of 30 mm has been found very effective. In this case the diameter of the needle was 1.5 mm. At its tip the needle was conically pointed, the cone being approximately 10 mm long. The rate of rotation of the needle was 60,000 rpm. Twists per meter of 600 were attained. The drawing velocity was 100 meters per minute. It may be noted that the needle may preferably also be supported in two pairs of rotatable support rolls (not shown), of which at least one roll is driven and the needle being held by magnetic forces in the nip of each pair of support rolls.

Needle 123 may also be hollow, as shown. A core thread 130 is fed through needle 123. This core thread thus forms automatically the core of the yarn to be formed. As such, it determines very substantially the textile properties of the formed yarn sliver, particularly the strength and elongation properties. Use of the needle is possible in all of the methods and devices described herein.

FIGS. 6*a* and 6*b* illustrate a yarn forming device with a fibre feeding unit 45. The spinning device consists of sieve drum cylinders 41 and 42 driven in the same directions of rotation. In these cylinders, air suction means are provided, of which in FIG. 6*a* the ducts 43 and 44 are visible. The fibre feeding unit comprises a housing 45 in which a continuous filament or filament tow is broken into staple fibres and fed against cylinder 41 adjacent the nip (narrowest gap) between the cylinders. The section of the housing 45 is along a tangential plane through the nip of the cylinders. A feed roller 47 and carding roller 48 are rotatably supported in the housing 45 and are driven rotatably by drive means (not shown). A roving 46 is drawn into the housing 45 by roller 47 and is transported into the range of the surface of carding roller 48. Carding roller 48 has teeth 53, known per se. Teeth 53 separate the fibres which are compounded in roving 46 and transport them on the surface of the roller to the entrance 50 of slot 51. Due to centrifugal force and the air current from air injector 49, the individual fibres flow into slot 51 in an orientation substantially parallel to the axis of the carding roll. The slot 51 narrows in a direction parallel to the axis of the carding roll. Therefore, the mouth 52 of the slot 51 extends parallel to the narrowest gap between the cylinders 41 and 42 and has a length which is matched to the staple fibre length. It is at least one-third of the air-permeable length of the cylinders 41, 42. Mouth 52 has a width of only a few millimeters (1–5 mm). By virtue of such cross section changes of the slot 51 and due to the action of the air currents supplied by injector 49, the fibres are turned until they are oriented in the direction of the line of yarn formation 9 and impinge on such line at an angle of less than 30°. The fibres are then twisted into the completed yarn sliver 10. Further air flow channels (not shown) may be provided in the slot 51 between the entrance channel 50 and mouth 52. These additional channels would be disposed to enhance the rotation and orientation of the fibres in the manner set forth above.

In FIG. 6*b*, the overall combination of roving feed, a carding roller and sieve drum cylinders is like that of FIG. 6*a*. The fibre feed slot or channel 51', however, is different from the slot or channel 51. The feed slot 51' favors more parallel orientation of the fibres with respect to each other and to the line of yarn formation as the fibres move from the entrance 50 through the slot to the nip of the sieve drum cylinders, and further favors a greater degree of linearity of the individual, moving fibres.

In FIG. 6*b*, the mouth 52' is more displaced relative to the entrance 50 in the direction of linear movement of the yarn being produced. Whereas the rear wall of the slot 51 in FIG. 6*a* is substantially at 90° to the line of yarn formation, the rear wall 56 in FIG. 6*b* of the slot or channel 51' lies at an angle $\epsilon$ of less than 60° relative to the line of yarn formation. Also, the front wall 55 lies at an angle $\delta$ less than angle $\epsilon$ and smaller than 45°.

The invention is hereby claimed as follows:

1. A process for spinning fibers to form a yarn which comprises rotating a body of discrete fibers in a yarn forming zone in a space between two adjacent air permeable surfaces moving in substantially opposite directions across the yarn forming zone, while passing respective currents of air through different segments of said space separated by and on opposite sides of the yarn being formed in said yarn forming zone, the respective currents of air flowing through said space in substantially opposite directions with the vectors of movement of said moving surfaces and the vectors of movement of said currents of air respectively on said opposite sides of the yarn being formed and being the same as the direction of rotation of the yarn which is being formed and also collectively encircling said yarn which is being formed.

2. A process as claimed in claim 1 wherein said vectors of movement of said surfaces are in parallel planes on opposite sides of said yarn forming zone.

3. A process as claimed in claim 1 wherein the distance between said surfaces in the yarn forming zone is adjusted to a distance not less than the diameter of the yarn which is being formed.

4. A process as claimed in claim 1 wherein said surfaces are spaced cylindrical surfaces orbiting in the same direction of rotation with the yarn forming zone lying in the space between said cylindrical surfaces and in a plane drawn through the axes of rotation of said cylindrical surfaces.

5. A process as claimed in claim 1 wherein fibers of one origin are fed in the vicinity of said yarn forming zone to one of said moving surfaces while fibres of a different origin are fed in the vicinity of said yarn forming zone to the other of said moving surfaces, thereby producing a yarn having intermixed fibers of different origins.

6. A process as claimed in claim 1 wherein fibers of different origins are fed to said yarn forming zone at places axially displaced along the axial direction of the yarn being formed whereby the fibers of one origin become the core of the yarn produced and the fibers of the other origin become the core-surrounding sheath of the yarn produced.

7. A process as claimed in claim 1 wherein a continuous filament is delivered axially through said yarn forming zone whereby the filament becomes the core of said yarn.

8. A process as claimed in claim 1 wherein said air permeable surfaces are spaced cylindrical surfaces orbiting in the same direction of rotation with the yarn forming zone lying in the space between said cylindrical surfaces, and fibers of one origin are fed to one of said cylindrical surfaces ahead of said yarn forming zone while fibers of a different origin are fed to the other of said cylindrical surfaces on the opposite side of said yarn forming zone, thereby producing a yarn having intermixed fibers of different origins.

9. A process as claimed in claim 1 wherein said moving surfaces are respectively hyperbolically concave and are generated by respective hyperboloids orbited about respective axes of rotation of said surfaces, which axes are at such angle relative to each other so that the longitudinal axis of the yarn produced in said yarn producing zone between said hyperbolically concave surfaces is parallel to one generatrix of each hyperboloid, and fibers of one origin are fed to one of said hyperbolically concave surfaces ahead of said yarn forming zone while fibers of a different origin are fed to the other of said hyperbolically concave surfaces on the other side of said yarn forming zone, thereby producing a yarn having intermixed fibrids of different origins.

10. A process for spinning fibers to form a yarn which comprises rotating a body of discrete fibers in a yarn forming zone between two adjacent air permeable surfaces moving in substantially opposite directions at the yarn forming zone while passing respective currents of air in respective opposite directions through said permeable surfaces near the body of rotating fibers and thereby forming a yarn, and the vectors of movement of both of said surfaces at said yarn forming zone having a component in the direction of the axis of the yarn being formed to impart axial movement of said yarn through the yarn forming zone.

11. A process for spinning fibers to form a yarn which comprises rotating a body of discrete fibers in a yarn forming zone between two adjacent air permeable surfaces moving in substantially opposite directions while passing respective currents of air in respective opposite directions through said permeable surfaces near the body of rotating fibers and thereby forming a yarn, the improvement wherein said moving surfaces are respectively hyperbolically concave and are generated by respective hyperboloids orbited about respective axes of rotation of said surfaces, which axes are at such angle relative to each other so that the longitudinal axes of the yarn produced in said yarn producing zone between said hyperbolically concave surfaces is parallel to one generatrix of each hyperboloid.

12. A process as claimed in claim 11, characterized by feeding a continuous filament between said adjacent air permeable surfaces and within the fibers being spun into said yarn whereby the continuous filament becomes the core of said yarn.

13. Apparatus for production of yarns from discrete fibers which comprises two, spaced, air permeable surfaces moving in opposite directions on opposite sides of a yarn producing zone situated in a narrow space between said surfaces, first and second air suction means each respectively embodying an air entry opening extending longitudinally adjacent said yarn producing zone on the respective sides of said moving surfaces which are remote from said zone for drawing respective currents of air through said moving surfaces, each of said air entry openings being positioned relative to said yarn producing zone to draw substantially all of its current of air through its respective moving surface in the area thereof immediately preceding the yarn producing zone, as viewed in the direction of movement of its respective moving surface, and feed means for feeding discrete fibers between said surfaces in the vicinity of said yarn forming zone.

14. Apparatus as claimed in claim 13 wherein said surfaces in the region of said yarn producing zone lie in spaced, parallel planes.

15. Apparatus as claimed in claim 13 wherein said surfaces are cylindrical, spaced, air permeable surfaces orbitable about respective, parallel axes of rotation, a common plane through which intersects said yarn producing zone in the nip between said cylindrical surfaces.

16. Apparatus as claimed in claim 13 wherein said surfaces are surfaces of respective, air permeable, endless belt means having opposed spaced planar segments providing said yarn producing zone.

17. Apparatus as claimed in claim 13, and in combination with a yarn twisting device for imparting twist to the yarn produced by said apparatus.

18. Apparatus as claimed in claim 13, and in combination with a yarn twisting device for imparting twist to the yarn produced by said apparatus, and means on said twisting device to impart axial movement to the yarn running into and through said device.

19. Apparatus as claimed in claim 13 wherein said air permeable surfaces are substantially cylindrical, air permeable surfaces orbiting in the same direction with a small gap therebetween, each of said air suction means respectively having its air-entry opening adjacent the inner face of its respective surface in the vicinity of said line of yarn formation, which is substantially in the narrowest gap between said surfaces, said air-entry openings respectively having a longitudinal edge portion extending longitudinally adjacent said line of yarn formation, and said longitudinal edge portions having relative positions ranging from no overlap across said gap up to an overlap with each other across said gap by an overlap width of up to 10 times the diameter of the yarn produced by said apparatus.

20. Apparatus as claimed in claim 19 wherein said longitudinal edge portion of air-entry openings overlap with each other, as viewed across said yarn producing zone, by an overlap width of up to 10 times the diameter of the yarn produced by said apparatus, the overlapping portions of said openings being disposed, as viewed in the direction of feed of fibres toward said gap, ahead of the narrowest gap between said surfaces.

21. Apparatus as claimed in claim 19 wherein respective edge portions of said air-entry openings are substantially aligned as viewed across said yarn producing zone.

22. Apparatus as claimed in claim 13 wherein the respective air entry openings each have a longitudinal edge portion adjacent to and extending longitudinally along said yarn producing zone, said edge portions having a small overlap as viewed across said yarn producing zone.

23. Apparatus as claimed in claim 13 wherein said air entry openings have relative positions ranging from no overlap as viewed across said yarn producing zone up to an overlap of their longitudinal edge portions as viewed across said zone by an overlap width of up to ten times the diameter of the yarn produced by said apparatus.

24. Apparatus as claimed in claim 23 wherein said air-entry openings overlap with each other by an overlap width of up to ten times the diameter of the yarn produced by said apparatus, the overlapping portions of said openings being disposed, as viewed in the direction of feed of fibers toward said yarn producing zone, ahead of said yarn producing zone.

25. Apparatus as claimed in claim 23 wherein the respective longitudinal edge portions of said air-entry openings closest to the yarn producing zone are substantially aligned as viewed across said yarn producing zone.

26. Apparatus as claimed in claim 13 wherein the air permeable surfaces are surfaces of respective, air permeable, endless belt means having opposed spaced planar segments having diagonally opposite, linear directions of travel and crossing each other at said yarn producing zone.

27. Apparatus as claimed in claim 26 wherein longitudinal edge portions of said air-entry openings have a small overlap with each other as viewed across said yarn producing zone.

28. Apparatus as claimed in claim 26 wherein the respective longitudinal edge portions of said air-entry openings closest to said yarn producing zone are substantially aligned as viewed across said yarn producing zone.

29. Apparatus as claimed in claim 13 wherein the air permeable surfaces are respectively hyperbolically concave and are generated by respective hyperboloids oribited about respective axes of rotation of said surfaces, which axes are at such angle relative to each other so that the longitudinal axis of the yarn produced in said yarn producing zone between said hyperbolically concave surfaces is parallel to one generatrix of each hyperboloid.

30. Apparatus as claimed in claim 29 wherein the longitudinal edge portions of said air-entry openings overlap with each other as viewed across said yarn producing zone.

31. Apparatus as claimed in claim 30 wherein longitudinal edge portions of said air-entry openings overlap, ahead of the narrowest gap between said hyperbolically concave surfaces and toward the side thereof from which the fibres are fed.

32. Apparatus for production of yarns from discrete fibers which comprises two, spaced, air permeable surfaces moving in opposite directions and providing therebetween a yarn producing zone, first and second air suction means on the respective sides of said moving surfaces which are remote from said zone for drawing respective currents of air through said moving surfaces, each of said air suction means providing through its respective moving surface a current of air immediately preceding the yarn producing zone, as viewed in the direction of movement of its respective moving surface, and feed means for feeding discrete fibers between said surfaces in the vicinity of said yarn forming zone, wherein said surfaces are surfaces of respective, air permeable, endless belt means having opposed spaced planar segments having diagonally opposite, linear directions of travel and crossing each other at said yarn producing zone.

33. Apparatus for production of yarns from discrete fibers which comprises two, spaced, air permeable surfaces moving in opposite directions and providing therebetween a yarn producing zone, first and second air suction means on the respective sides of said moving surfaces which are remote from said zone for drawing respective currents of air through said moving surfaces, each of said air suction means providing through its respective moving surface a current of air immediately preceding the yarn producing zone, as viewed in the direction of movement of its respective moving surface, and feed means for feeding discrete fibers between said surfaces in the vicinity of said yarn forming zone embodying a first feed device for supply of discrete fibers onto one moving surface ahead of said yarn forming zone, as viewed in the direction of movement of said one moving surface, and a second feed device for supply of discrete fibers onto the other moving surface ahead of said yarn forming zone, as viewed in the direction of movement of said other moving surface.

34. Apparatus for production of yarns from discrete fibers which comprises two, spaced, air permeable surfaces moving in opposite directions and providing therebetween a yarn producing zone, first and second air suction means on the respective sides of said moving surfaces which are remote from said zone for drawing respective currents of air through said moving surfaces, each of said air suction means providing through its respective moving surface a current of air immediately preceding the yarn producing zone, as viewed in the direction of movement of its respective moving surface, and feed means for feeding discrete fibers between said surfaces in the vicinity of said yarn forming zone, wherein said moving surfaces are respectively hyperbolically concave and are generated by respective hyperboloids orbited about respective axes of rotation of said surfaces, which axes are at such angle relative to each other so that the longitudinal axis of the yarn produced in said yarn producing zone between said hyperbolically concave surfaces is parallel to one generatrix of each hyperboloid.

35. Apparatus as claimed in claim 34, wherein said feed means embodies a fiber outlet positioned to feed discrete fibers onto a generatrix of the hyperboloid moving surfaces.

36. Apparatus as claimed in claim 34, wherein a disc, the diameter of which is greater than the diameters of the transverse cross-sections of the hyperboloid, is mounted at the axial end of each hyperboloidal moving surface which is adjacent the point of discharge of the produced yarn from said yarn producing zone.

37. Apparatus as claimed in claim 34, and means for adjustably changing the axis of rotation of one hyperboloid surface relative to the other hyperboloid surface.

38. Apparatus as claimed in claim 34 wherein the axes of rotation of said hyperboloids are disposed so that the narrowest gap therebetween becomes smaller in the direction toward the point of yarn discharge from said hyperboloid surfaces.

39. Apparatus as claimed in claim 34, in combination with yarn twist means for imparting additional twist to the yarn produced by said apparatus while also imparting axial motion to said yarn.

40. A process wherein discrete fibers are spun into a yarn between two opposed surfaces moving in opposite directions while drawing an air current through at least one of said surfaces in a defined area thereof, the line of yarn formation being within a defined area of said opposed surfaces, said surfaces imparting rotation to said fibers and also axial motion to the yarn being produced along said line of yarn formation, characterized by said surfaces having motion vectors which intersect at an angle in the narrowest gap between said surfaces and that the defined area of said line of yarn formation lies substantially on a line bisecting said angle.

41. A process as claimed in claim 40 wherein said opposed surfaces are respective hyperboloid surfaces.

42. A process as claimed in claim 41 wherein the circumferential velocity u of the hyperboloid surfaces lies, at the point of discharge of the yarn, in the range of $$4{,}25 \times 10^{-3} \frac{am \times V_a}{\sqrt{\delta} \times \sin\alpha} < \mu < 0{,}95 \frac{V_a}{\cos\alpha}$$

wherein $\alpha_m$ is the metric rotation coefficient, $V_a$ is the yarn withdrawal velocity in meters per minute, $\gamma$ is the specific weight in grams per $cm^3$, $\alpha$ is one half of the angle between the motion vectors of the surface velocities of the hyperboloid circumferential surfaces in the narrowest gap between parallel genetrices, and u is said circumferential velocity in meters per minute.

43. A process as claimed in claim 41 wherein the circumferential velocity u of the hyperboloid surfaces lies in a range of $$4{,}25 \times 10^{-3} \frac{am \times V_a \times \sin\alpha}{\sqrt{\delta}} + V_a \times \cos\alpha < \mu < 0{,}85 \frac{V_a}{\cos\alpha}$$

wherein $\alpha_m$ is the metric rotation coefficient, $V_a$ is the yarn withdrawal velocity in meters per minute, $\gamma$ is the specific weight in grams per $cm^3$, $\alpha$ is one half of the angle between the motion vectors of the surface velocities of the hyperboloid circumferential surfaces in the narrowest gap between parallel genetrices, and u is said circumferential velocity in meters per minute.

44. A process wherein discrete fibers are spun into a yarn along a line of yarn formation in a gap between two opposed surfaces moving in opposite directions while a current of air passes through at least one of said surfaces in a defined area adjacent said line of yarn formation, characterized by rotating a needle coaxially with the line of yarn formation in the same direction as the direction of rotation of the fibres between said surfaces with the tip of said needle positioned within the rotating fibres.

45. A process as claimed in claim 44 wherein said needle is hollow, and feeding a continuous core filament or yarn into the center of said rotating fibres.

46. Apparatus for producing yarns for discrete fibers which comprises two, spaced surfaces moving in opposite directions, at least one of said surfaces being air permeable, means for passing a current of air through the air permeable surface or surfaces, said surfaces and current of air imparting rotation to said fibres to cause them to twist into a yarn along a line of yarn formation between said surfaces, characterized by a rotatably driven needle which is coaxially with said line of yarn formation and the tip of the needle extending between said surfaces and into the body of fibres rotating between said surfaces.

47. Apparatus as claimed in claim 46 wherein said needle is hollow, and means for feeding a continuous filament or yarn axially through said needle and out its tip into the center of the rotating fibres.

48. Apparatus for producing yarns from discrete fibres which comprises first and second bodies of rotation having circumferential surfaces defined by revolving hyperboloids about axes of revolution, the axes of rotation of said bodies being oriented relative to each other such that the hyperboloid surfaces form a nip limited by a corresponding generatrix, at least one of said surfaces being air permeable, means to provide a current of air through said air permeable surface or surfaces along an area whose borders are parallel with the generatrix forming said nip and between the line of yarn formation, between said surfaces, and the nip.

49. Apparatus as claimed in claim 48 and means adjustably mounting one of said bodies of rotation for adjustable movement relative to the other body of rotation.

50. Apparatus as claimed in claim 48, characterized by the positioning of the axes of said bodies of rotation with respect to each other so that the nip between the hyperboloid surfaces narrows in the direction of the point of discharge of the produced yarn from the apparatus.

51. Apparatus as claimed in claim 48, characterized by said hyperboloid surfaces being asymmetric in the axial direction.

52. A process for spinning fibres to form a yarn which comprises rotating a body of discrete fibres in a yarn forming zone in a space between two adjacent air permeable surfaces moving in substantially opposite directions across the yarn forming zone, while drawing through different segments of said space separated by and on opposite sides of the yarn being formed in said yarn forming zone two currents of air which respectively pass through opposite air permeable surfaces in an area of each extending longitudinally along and immediately preceding the yarn forming zone, as viewed in the direction of movement of its respective moving surface, to provide currents of air which collectively substantially encircle the yarn being produced and having respective vectors of movement which are the same as the direction of rotation of said yarn in said yarn producing zone.

53. A process as claimed in claim 52 wherein said currents of air respectively are drawn through said areas into respective entry openings extending longitudinally of said yarn forming zone behind the respective air permeable surface, and the longitudinal edge portion of said openings which are respectively closest to said yarn forming zone having a small overlap, as viewed across said yarn producing zone.

54. A process as claimed in claim 53 wherein said longitudinal edge portions overlap each other by an overlap width of up to 10 times the diameter of the yarn produced by the process.

* * * * *

UNITED STATES PATENT AND TRADEMARK OFFICE

CERTIFICATE OF CORRECTION

PATENT NO. : 4,130,983

DATED : December 26, 1978

INVENTOR(S) : Dammann et al

It is certified that error appears in the above-identified patent and that said Letters Patent are hereby corrected as shown below:

Column 6, line 15, the formula should be:

$$d\,(mm) = \frac{1.12838}{\sqrt{\gamma\,(g/cm^3) \times Nm}}$$

Column 7, line 65, the formula should be:

$$4.25 \times 10^{-3} \frac{\alpha m \times V_a}{\sqrt{\gamma} \times \sin\alpha} < u < 0.95 \frac{V_a}{\cos\alpha}$$

Column 8, line 1, the formula should be:

$$4.25 \times 10^{-3} \frac{\alpha m \times V_a \times \sin\alpha}{\sqrt{\gamma}} + V_a \times \cos\alpha < u < 0.85 \frac{V_a}{\cos\alpha}$$

Column 8, line 15, the formula should be:

| | | | | | | |
|---|---|---|---|---|---|---|
| U m/min | 100 | 200 | 400 | 600 | 800 | 900 |
| p (p) | 55 | 32 | 28 | 22 | 19 | 15.7 |
| T (1/m) | 375 | 505 | 630 | 680 | 730 | 795 |
| Strength (Rkm) | 5.7 | 9.2 | 11.8 | 11.2 | 10.2 | 8.4 |
| α metric | 76.5 | 103 | 128.6 | 138 | 149 | 162 |

UNITED STATES PATENT AND TRADEMARK OFFICE

CERTIFICATE OF CORRECTION

PATENT NO. : 4,130,983

DATED : December 26, 1978

INVENTOR(S) : Dammann et al

It is certified that error appears in the above-identified patent and that said Letters Patent are hereby corrected as shown below:

Column 11, line 63, at Claim 11, the claim should read:

"relative to ..... longitudinal axis of the".

Column 15, line 25, the formula should be:

$$4.25 \times 10^{-3} \frac{\alpha m \times V_a}{\sqrt{\gamma} \times \sin\alpha} < u < 0.95 \frac{V_a}{\cos\alpha}$$

Column 15, line 40, the formula should be:

$$4.25 \times 10^{-3} \frac{\alpha m \times V_a \times \sin\alpha}{\sqrt{\gamma}} + V_a \times \cos\alpha < u < 0.85 \frac{V_a}{\cos\alpha}$$

Signed and Sealed this

*Eighteenth* Day of *September 1979*

[SEAL]

*Attest:*

*Attesting Officer*

LUTRELLE F. PARKER

*Acting Commissioner of Patents and Trademarks*

UNITED STATES PATENT AND TRADEMARK OFFICE

CERTIFICATE OF CORRECTION

PATENT NO. : 4,130,983

DATED : December 26, 1978

INVENTOR(S) : Dammann et al

It is certified that error appears in the above-identified patent and that said Letters Patent are hereby corrected as shown below:

On the first page under [30] Foreign Application Priority Date, add the following priority date:

-- Dec. 15, 1976 Fed. Rep. of Germany ..... 2656787 --

Signed and Sealed this

*Sixth* Day of *November 1979*

[SEAL]

*Attest:*

RUTH C. MASON
*Attesting Officer*

LUTRELLE F. PARKER
*Acting Commissioner of Patents and Trademarks*